US011505359B2

(12) United States Patent
Ling et al.

(10) Patent No.: US 11,505,359 B2
(45) Date of Patent: Nov. 22, 2022

(54) PACKAGE

(71) Applicant: SHENZHEN SMOORE TECHNOLOGY LIMITED, Shenzhen (CN)

(72) Inventors: Jianbo Ling, Shenzhen (CN); Siguang Qi, Shenzhen (CN)

(73) Assignee: shenzhen smoore technology limited, Shenzhen (CN)

( * ) Notice: Subject to any disclaimer, the term of this patent is extended or adjusted under 35 U.S.C. 154(b) by 0 days.

(21) Appl. No.: 17/316,980

(22) Filed: May 11, 2021

(65) Prior Publication Data

US 2021/0354872 A1 Nov. 18, 2021

(30) Foreign Application Priority Data

May 15, 2020 (CN) ..... 202020812684.6

(51) Int. Cl.

| | |
|---|---|
| ***B65D 5/38*** | (2006.01) |
| ***B65D 5/50*** | (2006.01) |
| ***B65D 50/04*** | (2006.01) |
| ***A47B 88/988*** | (2017.01) |

(52) U.S. Cl.

CPC ..... *B65D 5/38* (2013.01); *A47B 88/988* (2017.01); *B65D 5/503* (2013.01); *B65D 50/046* (2013.01)

(58) Field of Classification Search

CPC ..... B65D 5/38; B65D 5/503; B65D 5/5038; B65D 50/046; B65D 2215/02; A47B 88/988

USPC ..... 206/1.5, 468, 531, 538, 540; 229/125.125

See application file for complete search history.

(56) References Cited

U.S. PATENT DOCUMENTS

| | | | | |
|---|---|---|---|---|
| 9,376,246 | B2 * | 6/2016 | Jones | B65D 75/367 |
| 2012/0234701 | A1 * | 9/2012 | Albrecht | B65D 83/0463 206/1.5 |
| 2013/0193029 | A1 * | 8/2013 | Weston | B65D 83/0463 206/531 |
| 2014/0262839 | A1 * | 9/2014 | Le | B65D 83/0463 53/396 |
| 2017/0297803 | A1 * | 10/2017 | Chambers | B65D 5/5035 |
| 2020/0180808 | A1 * | 6/2020 | Gauvin | B65D 5/38 |
| 2021/0016939 | A1 * | 1/2021 | Palmer | B65D 5/44 |

OTHER PUBLICATIONS

Office Action for Canadian Application No. 3,118,971 dated Aug. 29, 2022.

* cited by examiner

*Primary Examiner* — Luan K Bui

(74) *Attorney, Agent, or Firm* — Dorsey & Whitney LLP

(57) ABSTRACT

A package includes a housing assembly and a drawer assembly. The housing assembly is provided with an open cavity, and the housing assembly has an unlocking member and a blocking surface. The drawer assembly is configured to carry an article and is engaged with the open cavity to receive the article in the open cavity. The drawer assembly includes an elastic member. When the elastic member abuts against the blocking surface, the blocking surface prevents the drawer assembly from sliding out of the open cavity. When a force is applied to the unlocking member to deform the elastic member, the elastic member is misaligned with the blocking surface so that the drawer assembly can slide out of the open cavity.

8 Claims, 6 Drawing Sheets

PACKAGE

CROSS-REFERENCE TO RELATED APPLICATION

This application claims priority to Chinese Patent Application No. 2020208126846, entitled "PACKAGE", filed May 15, 2020, the entire content of which are incorporated herein by reference.

TECHNICAL FIELD

The present disclosure relates to packing technologies, and more particularly relates to a package.

BACKGROUND

The smoke generated by burning tobacco contains dozens of carcinogens, such as tar, which can cause great harm to human health. Moreover, the smoke permeates into the air to form second-hand smoke, which can also cause harm to the human body after inhalation by the surrounding people. Therefore, smoking is prohibited in most public places. An electronic atomization device has an appearance and a mouthfeel similar to those of a common cigarette, but generally does not contain other harmful components such as tar and suspended particles in the cigarette. Therefore, the electronic atomization device is generally used as a substitute for the cigarette.

The entire electronic atomization device or an atomizer of the electronic atomization device is usually housed in a package. However, children have a curious, active, and imitative nature. In the case where the children can easily open the package to contact the atomizer, there is a risk of miseating oil in the atomizer by the children and a potential safety hazard.

SUMMARY

According to various embodiments of the present disclosure, a package is provided.

A package comprising:

a housing assembly provided with an open cavity, the housing assembly having an unlocking member and a blocking surface;

a drawer assembly configured to carry an article and comprising an elastic member; wherein the drawer assembly is received in the open cavity and the elastic member abuts against the blocking surface. The blocking surface is configured to prevent the drawer assembly from sliding out of the open cavity; the unlocking member is configured to press the elastic member to enable the elastic member and the blocking surface to be misaligned, so that the drawer assembly is capable of sliding out of the open cavity.

In one embodiment, the drawer assembly further includes a bottom plate and a side frame. The side frame is connected to edges of the bottom plate to be disposed around the bottom plate. The bottom plate and the side frame enclose a receiving cavity for receiving the article. The elastic member includes an abutment portion connected to the bottom plate and located outside the receiving cavity. The abutment portion is capable of abutting against the blocking surface, and the unlocking member is configured to press the abutment portion to deform the elastic member.

In one embodiment, the abutment portion has a sheet structure. The abutment portion and the bottom plate intersect to form an acute included angle. An opening of the acute included angle faces toward a direction in which the drawer assembly slides out of the open cavity, and the abutment portion is movable relatively away from or close to the bottom plate.

In one embodiment, the elastic member further includes a fixing portion connected to the abutment portion in a bending manner. The bottom plate is provided with a clamping cavity and an avoiding groove which are in communication with each other. The clamping cavity and the receiving cavity are isolated from each other. The fixing portion is fixed in the clamping cavity and hidden at an inner side of the bottom plate. The abutment portion passes through the avoiding groove and is exposed at an outer side of the bottom plate, and the abutment portion is capable of swinging relative to the fixing portion.

In one embodiment, the drawer assembly further includes a pull tab disposed on the bottom plate. The pull tab includes an exposed portion located outside contours of both the bottom plate and the side frame. The exposed portion is located outside the open cavity when the drawer assembly is engaged with the open cavity.

In one embodiment, the pull tab is attached to the bottom plate, and the pull tab is spaced equally from both ends of the bottom plate in a width direction of the bottom plate.

In one embodiment, the drawer assembly further includes a gasket disposed within the receiving cavity and configured to secure the article.

In one embodiment, the housing assembly includes a housing defining the open cavity. The housing is provided with a curved groove in communication with the open cavity and outside. The curved groove enables a part of the housing to form a pressing tongue having elasticity. The pressing tongue is capable of swinging toward an inside of the open cavity relative to the other part of the housing to form the unlocking member.

In one embodiment, the housing assembly includes a baffle and a housing defining the open cavity. The housing has an inner wall surface defining a part of a boundary of the open cavity. The baffle is attached to the inner wall surface and located within the open cavity. In a sliding direction of the drawer assembly, the baffle has an end surface provided away from an opening of the open cavity, and the end surface forms the blocking surface.

In one embodiment, the housing includes an end plate and a side barrel enclosing a cavity having openings at both ends. The end plate is connected to an end of the side barrel, and the end plate closes one opening of the cavity to form the open cavity.

When it is necessary to slide the drawer assembly carrying the article out of the open cavity of the housing assembly, a force needs to be applied to the unlocking member so that the unlocking member deforms the elastic member, and then the elastic member is misaligned with the blocking surface so that the drawer assembly can slide out of the open cavity. Otherwise, in the case where the elastic member is not misaligned with the blocking surface, the interference effect caused by the elastic member abutting against the blocking surface will not allow the drawer assembly carrying the article to slide out of the open cavity of the housing assembly. Therefore, when the child does not find the unlocking member, or the force applied to the unlocking member is insufficient to deform the elastic member to be misaligned with the blocking surface, the drawer assembly will not be able to carry the article out of the open cavity of the housing assembly, thereby preventing the child from being in contact with the article in the drawer assembly, and ultimately improving the safety of the package.

DETAILED DESCRIPTION OF THE EMBODIMENTS

Figure 1:
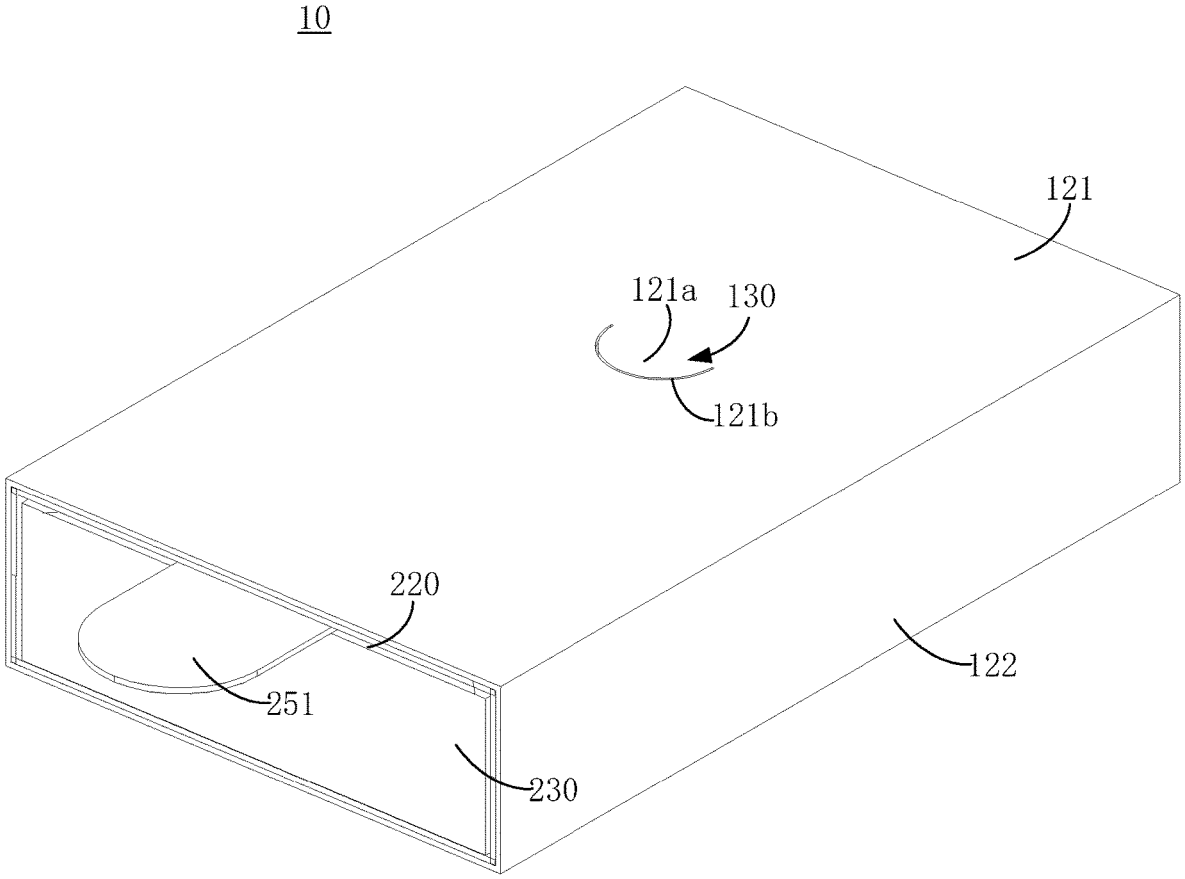
FIG. 1 is a perspective view of a package according to an embodiment when a drawer assembly is engaged with an open cavity of a housing assembly.

For the convenience of understanding of the present disclosure, the present disclosure will be described more fully with reference to related drawings. Preferred embodiments of the present disclosure are shown in the drawings. However, the present disclosure can be implemented in many different forms and is not limited to the embodiments described herein. In contrast, providing these embodiments is to providing a fully and thoroughly understanding of the disclosure of the present disclosure.

It should be noted that when an element is referred as to be "fixed" to another element, it can be directly on another element or there may be an intermediate element therebetween. When an element is considered to be "connected" to another element, it may be directly connected to another element or there may be an intermediate element therebetween at the same time. The terms "inner", "outer", "left", "right" and the like used herein are for illustration only and are not meant to be the only embodiment.

Figure 2:
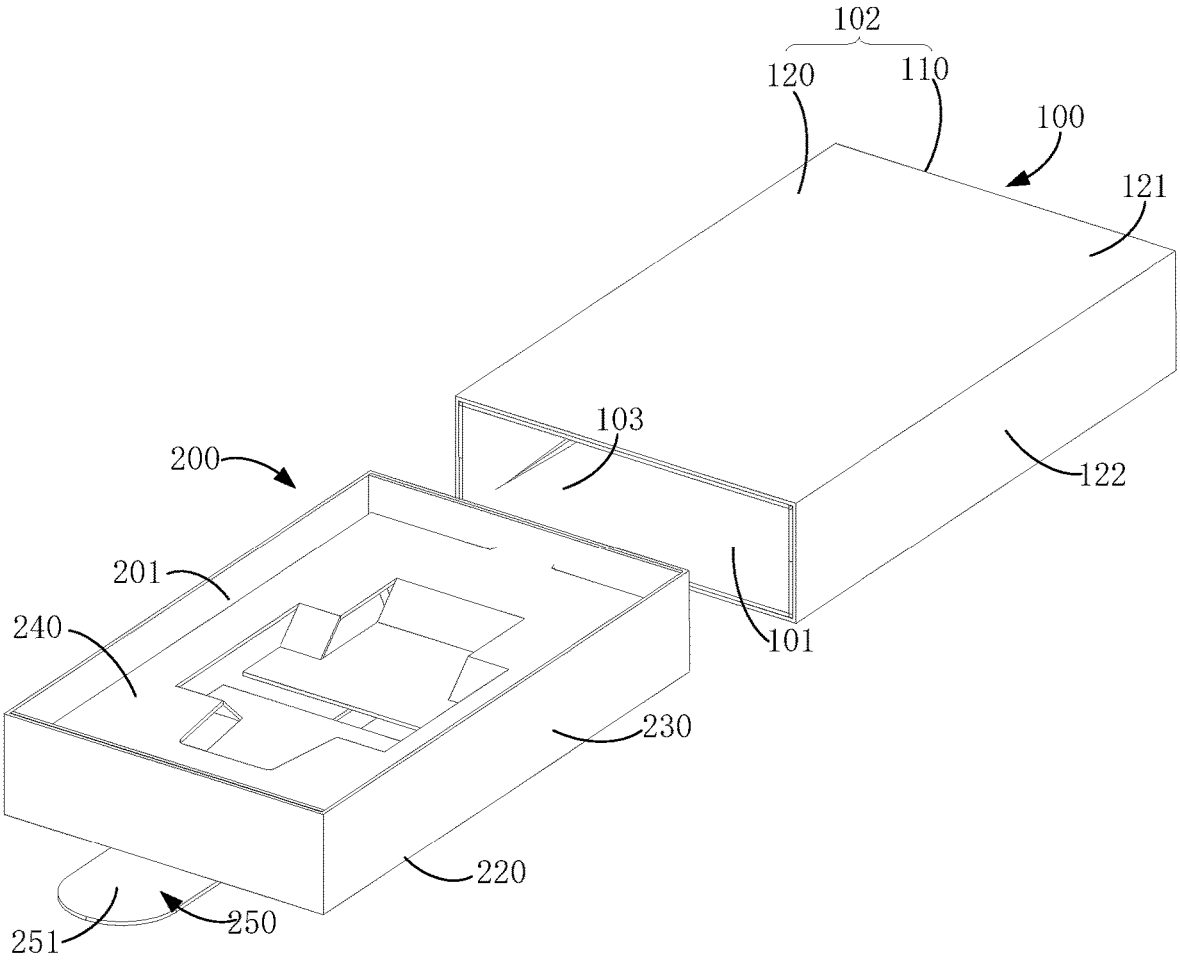
FIG. 2 is a perspective view of the package shown in FIG. 1 when the drawer assembly is located outside the open cavity of the housing assembly.

Referring to FIGS. 1 and 2, an embodiment of the present disclosure provides a package 10 for holding objects of an electronic atomization device, such as an atomizer or the like, in which the atomizer 10 can be held for a good protection. On one hand, the atomizer is prevented from being corroded by external dust and liquid droplets, and the atomizer is prevented from being damaged by external impact force directly acting on the atomizer. A further important aspect is to prevent children from easily removing the atomizer from the package 10 and to prevent the children from miseating the oil or other components in the atomizer to cause a safety accident.

Figure 3:
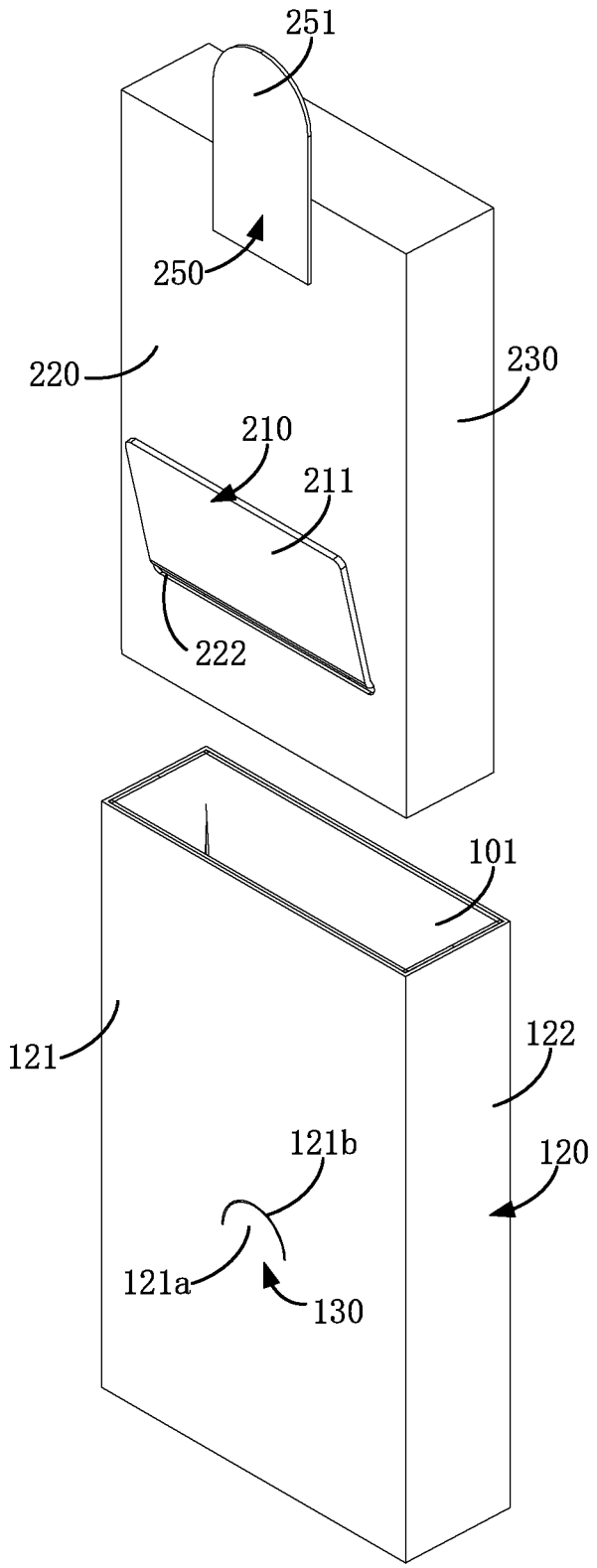
FIG. 3 is a perspective view of the package shown in FIG. 2 from another perspective.
Figure 4:
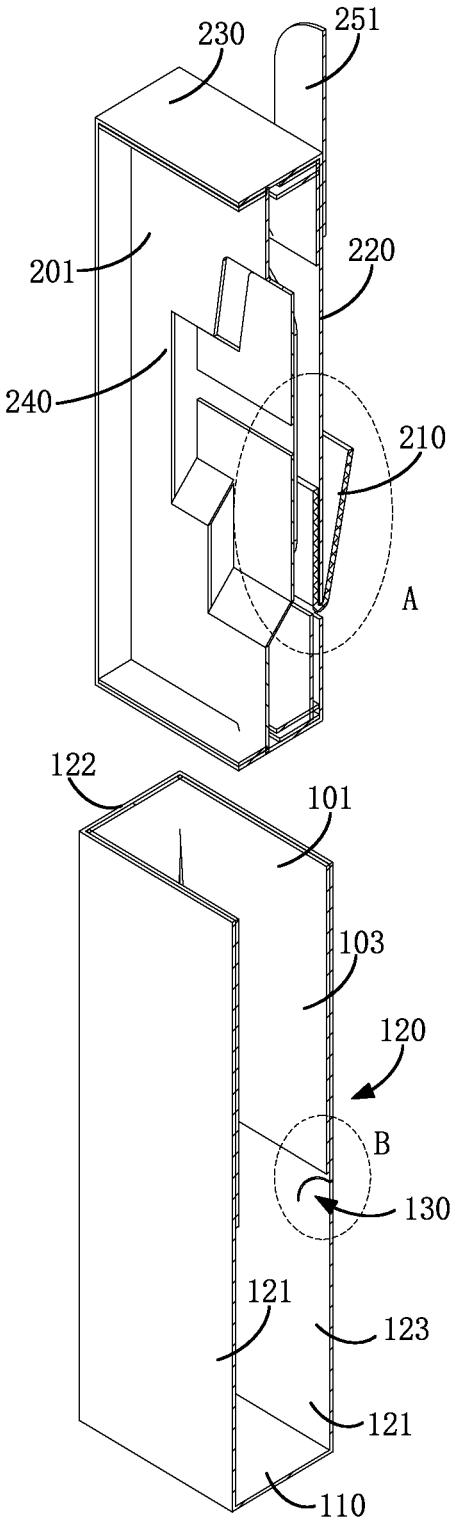
FIG. 4 is a perspective sectional view of the package shown in FIG. 3.
Figure 6:
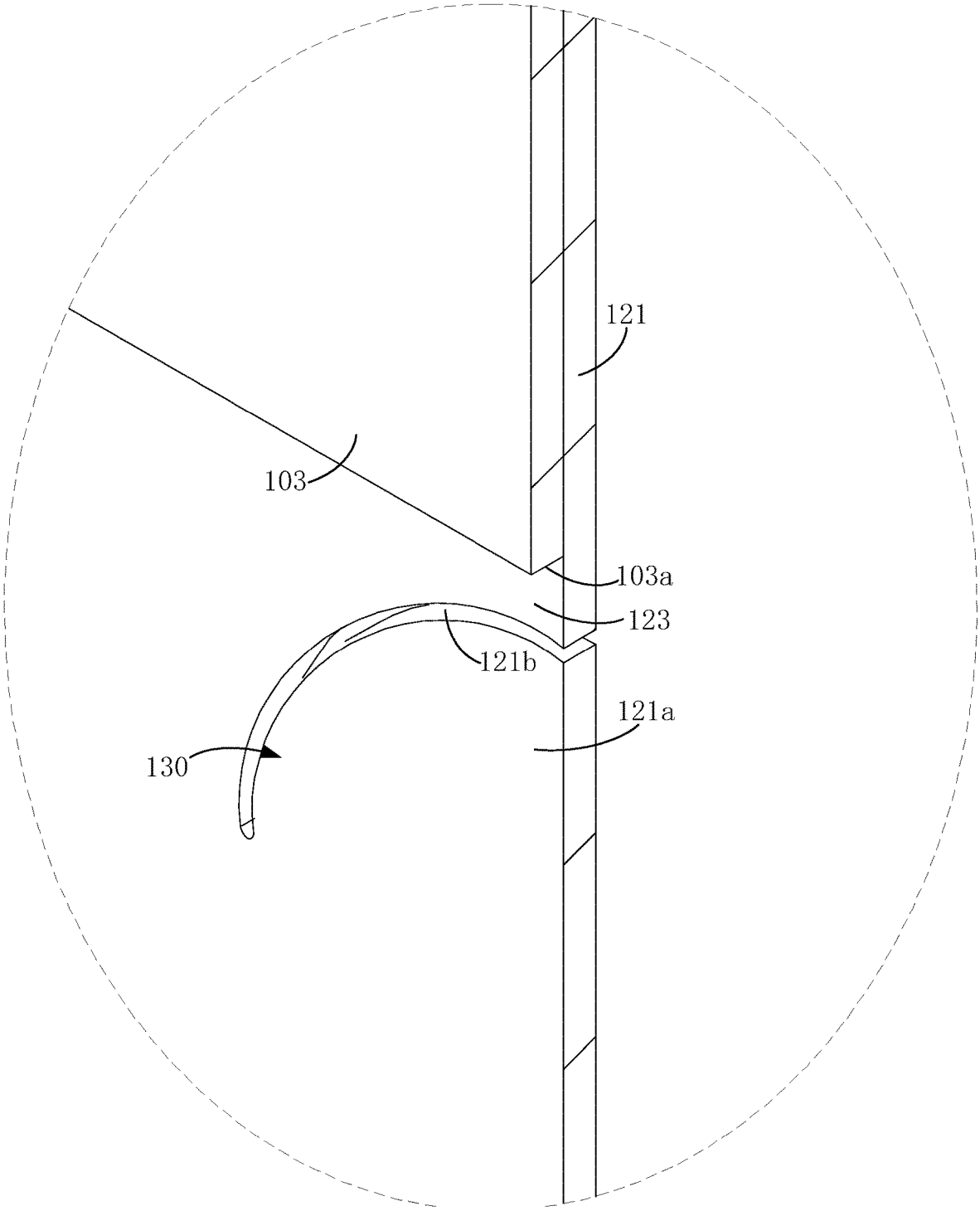
FIG. 6 is an enlarged view of a portion B in FIG. 4.

Referring to FIGS. 3, 4, and 6, the package 10 includes a housing assembly 100 and a drawer assembly 200. The housing assembly 100 is provided with an open cavity 101, and the drawer assembly 200 is used for carrying the atomizer. When the drawer assembly 200 is engaged with the open cavity 101 to be received in the open cavity 101, the atomizer 101 can also be received in the open cavity 101. The housing assembly 100 has an unlocking member 130 and a blocking surface 103*a*, and the drawer assembly 200 includes an elastic member 210. When the elastic member 210 abuts against the blocking surface 103*a*, the blocking surface 103*a* interferes with the elastic member 210, so that the blocking surface 103*a* prevents the drawer assembly 200 from sliding out of the open cavity 101, and the drawer assembly 200 cannot carry the atomizer out of the open cavity 101. When a force is applied to the unlocking member 130, the force is transmitted to the elastic member 210 through the unlocking member 130, so that the elastic member 210 is elastically deformed under the force to ensure that the elastic member 210 is misaligned with the blocking surface 103*a*, thereby eliminating the interference effect of the blocking surface 103*a* on the elastic member 210, and ensuring that the drawer assembly 200 can slide out of the open cavity 101, and in turn, the drawer assembly 200 carries the atomizer out of the open cavity 101.

Referring to FIGS. 2, 3, and 4, in some embodiments, the housing assembly 100 includes a housing 102 and a baffle 103. The housing 102 includes an end plate 110 and a side barrel 120 enclosing a cavity having openings at both ends. The cavity may have a rectangular cross-section, i.e., the side barrel 120 is cuboid-shaped. The end plate 110 is a rectangular plate, and the end plate 110 is connected to an end of the side barrel 120, so that the end plate 110 closes an opening at one end of the cavity, and in turn, the cavity forms the open cavity 101 having only one open end. Obviously, the cross-section of the open cavity 101 is also rectangular. The side barrel 120 may further include two first side plates 121 and two second side plates 122. Both the first side plates 121 and the second side plates 122 are rectangular plates. An area of the first side plate 121 is larger than that of the second side plate 122. Both ends of one first side plate 121 are respectively connected to one end of each of the two second side plates 122, and both ends of the other first side plate 121 are respectively connected to the other end of each of the two second side plates 122. The housing 102 may be made of a metal, plastic, or paper material, and the baffle 103 may also be made of a metal, plastic, or paper material.

The side barrel 120 has an inner wall surface 123 defining a part of a boundary of the open cavity 101. The inner wall surface 123 is formed by inner wall surfaces 123 of both the first side plate 121 and the second side plate 122. The baffle 103 may also be shaped as a rectangular plate, and the baffle 103 is located in the open cavity 101 and may be disposed adjacent to the opening of the open cavity 101. For example, one baffle 103 may be provided, and the baffle 103 is attached to the inner wall surface 123 of the first side plate 121. In other embodiments, four baffles 103 may be provided, and the baffles 103 are attached to the inner wall surfaces 123 of the two first side plates 121 and the two second side plates 122. When the baffle 103 is attached to the inner wall surface 123, the baffle 103 protrudes by a certain height from the inner wall surface 123. In a sliding direction of the drawer assembly 200, the baffle 103 has an end surface provided away from the opening of the open cavity 101. The end surface may be substantially perpendicular to the inner wall surface 123. For example, when the inner wall surface 123 is a vertical surface, the end surface is a horizontal surface. The end surface can just form the blocking surface 103*a* that can press against the elastic member 210. In other embodiments, the blocking surface 103*a* is not formed by the end surface of the baffle 103 attached to the inner wall surface 123, that is, the blocking surface 103*a* is not formed by a structure protruding from the inner wall surface 123. On the contrary, the blocking surface 103*a* is formed by a structure recessed into the inner wall surface 123. For example, a recess is formed in the inner wall surface 123, and a side wall of the recess can form the blocking surface.

Figure 5:
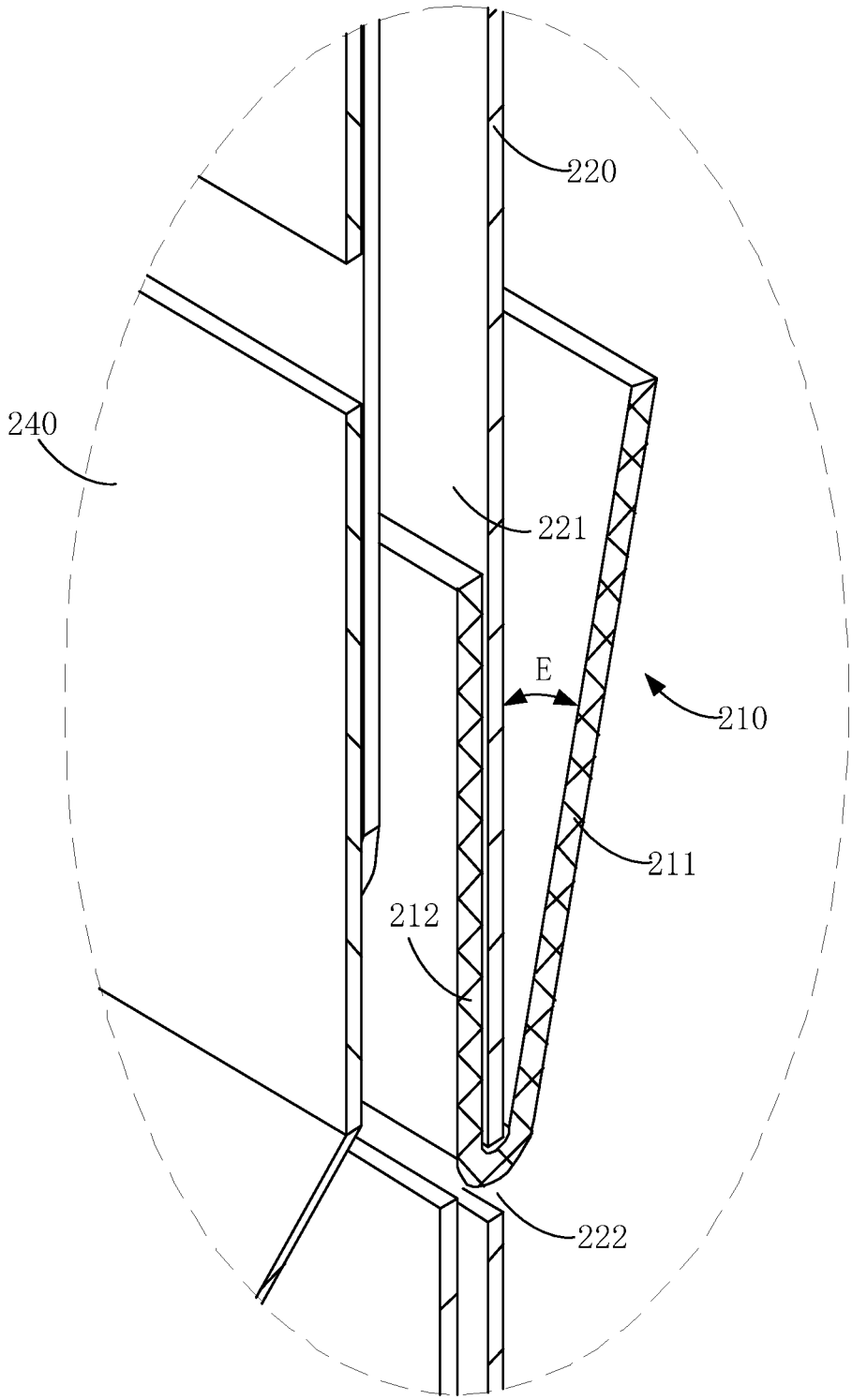
FIG. 5 is an enlarged view of a portion A in FIG. 4.

Referring to FIG. 4, FIG. 5, and FIG. 6, in some embodiments, the side barrel 120 may be provided with a curved groove 121*b*. For example, the curved groove 121*b* may be a semicircular groove or the like. The curved groove 121*b* extends through both the inner wall surface 123 and an outer surface of the side barrel 120, so that the curved groove 121*b* is in communication with both the open cavity 101 and the outside. By providing the curved groove 121*b*, a part of the side barrel 120 may be formed with a pressing tongue 121*a* having a certain elasticity. When a certain pressing force is applied to the pressing tongue 121*a* by hand, the pressing tongue 121*a* can swing toward an inside of the open cavity 101 relative to the other part of the side barrel 120 by a certain extent, so that the pressing tongue 121*a* applies an acting force on the elastic member 210, and the elastic member 210 is elastically deformed under the acting force to be misaligned with the blocking surface 103*a*, thereby eliminating the interference effect of the blocking surface 103*a* on the elastic member 210, and ensuring that the drawer assembly 200 can slide out of the open cavity 101. Therefore, the pressing tongue 121*a* just forms the unlocking member 130. The shape of the pressing tongue 121*a* is determined by the shape of the curved groove 121*b*. When the curved groove 121*b* may be a semicircular groove, the pressing tongue 121*a* is semicircular. When the curved groove 121*b* may be an elliptical groove or a rectangular groove, the pressing tongue 121*a* is elliptical or rectangular.

The width of the curved groove 121*b* is small, as long as it does not affect the swinging of the pressing tongue 121*a* toward the inside of the open cavity 101. The pressing tongue 121*a* is formed directly on the side barrel 120 through the curved groove 121*b*, so that the pressing tongue 121*a* is used as a part of the entire side barrel 120. That is, the pressing tongue 121*a* has an integrated visual feeling with the other part of the side barrel 120. In addition, due to the small width of the curved groove 121*b*, it is difficult for children with immature intelligence to find the existence of the pressing tongue 121*a*. This prevents a child from repeatedly fiddling with the pressing tongue 121*a*, prevents the pressing tongue 121*a* from abutting against the elastic member 210 to cause the elastic member 210 and the blocking surface 103*a* to be misaligned, so that the drawer assembly 200 cannot carry the atomizer to slide out of the open cavity 101. Therefore, the child is prevented from miseating oil or other parts in the atomizer to cause a safety accident, thereby improving the safety of the packaging 10. Moreover, an outer surface of the pressing tongue 121*a* and the outer surface of the other part of the side barrel 120 are parallel to each other. That is, the pressing tongue 121*a* does not recess or protrude with respect to the other part of the side barrel 120, and therefore, the arrangement of the pressing tongue 121*a* does not deteriorate the overall uniformity of the appearance of the entire side barrel 120. It is also possible to prevent the interference of pressing tongue 121*a*. When the first side plate 121 with the pressing tongue 121*a* is placed on the horizontal plane, the side barrel 120 is placed horizontally without being inclined, which facilitates the display of the entire package 10. In other embodiments, when the elastic force of the pressing tongue 121*a* has a reasonable value, the child cannot overcome the elastic force of the pressing tongue 121*a* to press the elastic member 210 by the pressing tongue 121*a*, thereby further improving the safety of the use of the package 10. Therefore, in the case where the child does not find the pressing tongue 121*a* or cannot make the pressing tongue 121*a* press against the elastic member 210, the drawer assembly 200 carrying the atomizer cannot slide out of the open cavity 101.

Referring to FIGS. 3, 4, and 5, in some embodiments, the drawer assembly 200 further includes a bottom plate 220, a side frame 230, a gasket 240, and a pull tab 250. The bottom plate 220 has a substantially rectangular plate-like structure, and the side frame 230 has a substantially rectangular cylindrical structure. The side frame 230 is connected to edges of the bottom plate 220, to be disposed around the bottom plate 220. The bottom plate 220 and the side frame 230 both enclose a receiving cavity 201. The receiving cavity 201 can have a rectangular cross-section. The atomizer is received in the receiving cavity 201 when the drawer assembly 200 carries the atomizer. The gasket 240 is disposed in the receiving cavity 201, and the gasket 240 plays a role in carrying and fixing the atomizer. The gasket 240 can be reasonably provided with a slot structure, when the atomizer is placed on the gasket 240, the shape of the outer surface of the atomizer can be adapted to the slot structure. That is, the slot structure has a certain limiting effect on the atomizer to prevent misalignment of the atomizer on the gasket 240. The gasket 240 may be made of a metal, plastic, or paper material.

In some embodiments, the elastic member 210 includes an abutment portion 211 and a fixing portion 212. The elastic member 210 may have a sheet-like structure, and the elastic member 210 may be a plastic elastic sheet or the like having a certain toughness. Both the fixing portion 212 and the abutment portion 211 are bent and connected to form an acute included angle. In this case, the elastic member 210 has a substantially V-shaped structure. The bottom plate 220 has an inner surface and an outer surface. The outer surface and the inner surface face toward opposite directions. The inner surface is used to define a part of the boundary of the receiving cavity 201. The bottom plate 220 is provided with a clamping cavity 221 therein. The bottom plate 220 is provided with an avoiding groove 222 at the outer surface thereof. The avoiding groove 222 is in communication with the clamping cavity 221. During the mounting of the elastic member 210, the fixing portion 212 is fixed in the clamping cavity 221 so that the fixing portion 212 is hidden at an inner side of the bottom plate 220. In this case, the abutment portion 211 passes through the avoiding groove 222 and is exposed at an outer side of the bottom plate 220. The abutment portion 211 is disposed opposite to the outer surface of the bottom plate 220. The abutment portion 211 can swing relative to the fixing portion 212. In addition, the abutment portion 211 and the outer surface of the bottom plate 220 intersect to form an acute included angle E. The value of the acute included angle E is substantially equal to the value of the acute included angle between the fixing portion 212 and the abutment portion 211. An opening of the acute included angle E faces toward the direction in which the drawer assembly 200 slides out of the open cavity 101.

One elastic member 210 may be provided. That is, the one elastic member 210 is mounted on the bottom plate 220 of the drawer assembly 200. When the drawer assembly 200 is received in the open cavity 101, one first side plate 121 of the side barrel 120 covers and closes the opening of the receiving cavity 201 of the drawer assembly 200, and the other first side plate 121 of the side barrel 120 is disposed opposite the outer surface of the bottom plate 220. In this case, in order to enable the pressing tongue 121*a* to apply an abutting force against the elastic member 210, so as to ensure that the pressing tongue 121*a* is disposed opposite to the elastic member 210, and the pressing tongue 121*a* is formed by the first side plate 121 disposed opposite to the outer surface of the bottom plate 220. In the case where the entire package 10 is placed horizontally, when it is necessary to move the drawer assembly 200 carrying the atomizer out of the open cavity 101, it is necessary to ensure that the opening of the receiving cavity 201 of the drawer assembly 200 faces upwards in order to prevent the atomizer from dropping from the receiving cavity 201 of the drawer assembly 200. Therefore, the first side plate 121 provided with the pressing tongue 121*a* is disposed downward. A user will hardly perceive the existence of the pressing tongue 121*a* during the use of the package 10, thereby ensuring the overall visual consistency of the entire package 10, thereby improving the appearance of the package 10 to a certain extent. In addition, since the first side plate 121 provided with the pressing tongue 121*a* is usually brought into direct contact with a carrier when the package 10 is placed, it is difficult for the child to find the pressing tongue 121*a*, so that the drawer assembly 200 cannot be slid out of the open cavity 101, and the safety performance of the package 10 can be improved to a certain extent.

In fact, the number of the elastic members 210, the pressing tongues 121*a*, and the baffles 103 are equal, and the elastic member 210, the pressing tongue 121*a*, and the baffle 103 are in a one-to-one correspondence relationship. For example, when one elastic member 210 is provided, the elastic member 210 is disposed on the bottom plate 220 of the drawer assembly 200, one pressing tongue 121*a* and one baffle 103 are provided, respectively. The baffle 103 is disposed on the inner wall surface 123 of the first side plate 121 disposed opposite to the outer surface of the bottom plate 220, and the pressing tongue 121*a* is formed by the first side plate 121. As another example, in addition to providing the elastic member 210 on the bottom plate 220 of the drawer assembly 200, the elastic member 210 may also be disposed on the side frame 230 of the drawer assembly 200. In this case, the baffles 103 are also disposed on the inner surfaces of the two second side plates 122 of the side barrel 120, and the pressing tongues 121*a* corresponding to the elastic members 210 are formed on each of the two second side plates 122. Therefore, by providing the plurality of elastic members 210 and the pressing tongues 121*a*, it is necessary to apply a force to all the pressing tongues 121*a* at the same time so that each of the elastic members 210 are simultaneously misaligned with the corresponding blocking surface 103*a*, so as to remove the interference of the blocking surfaces 103*a* and slide the drawer assembly 200 out of the open cavity 101. This further increases the difficulty for the child to slide the drawer assembly 200 out of the open cavity 101, thereby improving the safety performance of the package 10.

In some embodiments, the pull tab 250 has a generally elongate sheet-like structure. The pull tab 250 may be made of a transparent plastic material. In other embodiments, the pull tab 250 may also be made of other metallic or non-metallic materials. The pull tab 250 may be attached directly to the outer surface of the bottom plate 220. The pull tab 250 has an exposed portion 251 located outside the contour of both the bottom plate 220 and the side frame 230. When the drawer assembly 200 is engaged with the open cavity 101, the exposed portion 251 is also located outside the open cavity 101. When the pressing tongue 121*a* makes the elastic member 210 deformed so that the elastic member 210 is misaligned with the blocking surface 103*a*, the interference between the blocking surface 103*a* and the elastic member 210 is eliminated. Since the exposed portion 251 of the pull tab 250 is located outside the open cavity 101, a pulling force can be applied to the exposed portion 251, so that the entire drawer assembly 200 can be slid out of the open cavity 101, and the atomizer can be removed from the open cavity 101. In other embodiments, the side frame 230 may be provided with a countersink structure thereon, which may replace the pull tab 250. The drawer assembly 200 may likewise be slid out of the open cavity 101 when a user places a finger into the countersink structure to apply a pulling force to the drawer assembly 200.

In a width direction of the bottom plate 220, the pull tab 250 is spaced equally from both ends of the bottom plate 220. Generally, the pull tab 250 is centrally disposed on the bottom plate 220. Therefore, during applying a pulling force to the exposed portion 251 of the pull tab 250 to slide the drawer assembly 200 out of the open cavity 101, the stress on the drawer assembly 200 is more balanced, the drawer assembly 200 is ensured to slide along a straight line, the friction force between the drawer assembly 200 and each part of the housing 102 is ensured to be uniform, the drawer assembly 200 is prevented from being deviated during the sliding process to generate a larger squeezing force and friction force with a certain part of the housing 102. Therefore, the drawer assembly 200 is ensured to smoothly slide out of the open cavity 101, and the wear between the drawer assembly 200 and the housing 102 is reduced, thereby improving the convenience in use and service life of the package 10.

When it is necessary to slide the drawer assembly 200 carrying the atomizer out of the open cavity 101 of the housing assembly 100, in the first step, a pressing force is applied to the pressing tongue 121*a* so that the pressing tongue 121*a* overcomes elastic resistance to deflect toward the inside of the open cavity 101 to press the abutment portion 211 of the elastic member 210, and the abutment portion 211 swings toward the bottom plate 220. The acute included angle E between the abutment portion 211 and the bottom plate 220 is reduced. When the acute included angle E is reduced to a certain value, the abutment portion 211 is completely misaligned with the blocking surface 103*a* of the baffle 103. It can be seen that the acute included angle E decreases in value during the misalignment of the abutment portion 211 and the blocking surface 103*a*. In the second step, a pulling force is applied to the exposed portion 251 of the pull tab 250. Since the abutment portion 211 and the blocking surface 103*a* of the baffle 103 are completely misaligned, the abutment portion 211 and the blocking surface 103*a* are no longer in contact with each other and thus the interference effect is eliminated during the sliding process of the drawer assembly 200, so that the drawer assembly 200 can smoothly slide out of the open cavity 101, and thus the atomizer can be taken out of the drawer assembly 200 outside the open cavity 101.

When it is necessary to slide the drawer assembly 200 carrying the atomizer into the open cavity 101 of the housing assembly 100, a pushing force may be directly applied to the end of the drawer assembly 200 so that the drawer assembly 200 slides inwardly into the open cavity 101. At the moment when the abutment portion 211 of the elastic member 210 is separated from the baffle 103, the elastic member 210 releases energy, so that the acute included angle E between the abutment portion 211 and the bottom plate 220 is increased, and then the abutment portion 211 is directly abutted against the first side plate 121. In this case, when the acute included angle E is increased and remains unchanged, the blocking surface 103*a* is located on the sliding track where the abutment portion 211 slides along the inner wall surface 123 of the first side plate 121. When the drawer assembly 200 abuts against the end plate 110 of the housing 102, the drawer assembly 200 stops moving, and the drawer assembly 200 carries the atomizer and completely receives it in the open cavity 101. Since the blocking surface 103*a* is located on the sliding track where the abutment portion 211 slides along the inner wall surface 123, the blocking surface 103*a* and the abutment portion 211 cannot form a misalignment relationship, and then the interference effect of the blocking surface 103*a* on the movement of the abutment portion 211 cannot be eliminated. In the case where no acting force is applied to the pressing tongue 121*a* to reduce the acute included angle E, the drawer assembly 200 carrying the atomizer cannot be moved out of the open cavity 101.

Each the technical features of the embodiments described above can be arbitrarily combined. In order to simplify the description, all possible combinations of each technical features in the above embodiments have not been described. However, as long as there is no contradiction in the combination of these technical features, it should be considered as that all of them fall within the scope recorded in this specification.

The above-described embodiments only present several implementation manners of the present disclosure, and descriptions thereof are more specific and detailed, but they cannot be understood as limiting the scope of the application patent. It should be noted that, to those of ordinary skill in the art, several modifications and improvements can be made without departing from the concept of the present disclosure, which all fall within the protection scope of the present disclosure. Therefore, the protection scope of this application patent shall be subject to the appended claims.

What is claimed is:

1. A package, comprising:

a housing assembly provided with an open cavity, the housing assembly having an unlocking member and a blocking surface; and a drawer assembly configured to carry an article and including an elastic member; wherein the drawer assembly is received in the open cavity and the elastic member abuts against the blocking surface, the blocking surface is configured to prevent the drawer assembly from sliding out of the open cavity; the unlocking member is configured to press the elastic member to enable the elastic member and the blocking surface to be misaligned, so that the drawer assembly is capable of sliding out of the open cavity;

wherein the drawer assembly further includes a bottom plate and a side frame, the side frame is connected to edges of the bottom plate to be disposed around the bottom plate, the bottom plate and the side frame enclose a receiving cavity for receiving the article; the elastic member comprises an abutment portion connected to the bottom plate and located outside the receiving cavity, the abutment portion is capable of abutting against the blocking surface, and the unlocking member is configured to press the abutment portion to deform the elastic member; and wherein the elastic member further includes a fixing portion connected to the abutment portion in a bending manner, the bottom plate is provided with a clamping cavity and an avoiding groove which are in communication with each other, the clamping cavity and the receiving cavity are isolated from each other; the fixing portion is fixed in the clamping cavity and hidden at an inner side of the bottom plate, the abutment portion passes through the avoiding groove and is exposed at an outer side of the bottom plate, and the abutment portion is capable of swinging relative to the fixing portion.

2. The package of claim 1, wherein the abutment portion has a sheet structure, the abutment portion and the bottom plate intersect to form an acute included angle, an opening of the acute included angle faces toward a direction in which the drawer assembly slides out of the open cavity, and the abutment portion is movable relatively away from or close to the bottom plate.

3. The package of claim 1, wherein the drawer assembly further includes a pull tab disposed on the bottom plate, the pull tab comprises an exposed portion located outside contours of both the bottom plate and the side frame, and the exposed portion is located outside the open cavity when the drawer assembly is engaged with the open cavity.

4. The package of claim 2, wherein the pull tab is attached to the bottom plate, and the pull tab is spaced equally from both ends of the bottom plate in a width direction of the bottom plate.

5. The package of claim 1, wherein the drawer assembly further includes a gasket disposed within the receiving cavity and configured to secure the article.

6. The package of claim 1, wherein the housing assembly includes a housing defining the open cavity, the housing is provided with a curved groove in communication with the open cavity and outside, the curved groove enables a part of the housing to form a pressing tongue having elasticity, and the pressing tongue is capable of swinging toward an inside of the open cavity relative to the other part of the housing to form the unlocking member.

7. The package of claim 1, wherein the housing assembly includes a baffle and a housing defining the open cavity, the housing has an inner wall surface defining a part of a boundary of the open cavity, the baffle is attached to the inner wall surface and located within the open cavity, and in a sliding direction of the drawer assembly, the baffle has an end surface provided away from an opening of the open cavity, and the end surface forms the blocking surface.

8. The package of claim 7, wherein the housing includes an end plate and a side barrel enclosing a cavity having openings at both ends, the end plate is connected to an end of the side barrel, and the end plate closes one opening of the cavity to form the open cavity.

* * * * *